United States Patent [19]

Dodd et al.

[11] Patent Number: 4,917,574

[45] Date of Patent: Apr. 17, 1990

[54] AEROFOIL BLADE DAMPING

[75] Inventors: Alec G. Dodd; Edwin Pateman, both of Derby, England

[73] Assignee: Rolls-Royce plc, London, England

[21] Appl. No.: 381,971

[22] Filed: Jul. 19, 1989

[30] Foreign Application Priority Data

Sep. 30, 1988 [GB] United Kingdom ..... 8823024

[51] Int. Cl.[4] ..... F01D 5/22

[52] U.S. Cl. ..... 416/193 A; 416/190; 416/500

[58] Field of Search ..... 416/190, 193 A, 500

[56] References Cited

U.S. PATENT DOCUMENTS

| | | | |
|---|---|---|---|
| 2,310,412 | 2/1943 | Flanders | 416/190 |
| 2,349,187 | 5/1944 | Meyer | 416/190 |
| 2,862,686 | 12/1958 | Bartlett | 416/500 X |
| 2,912,223 | 11/1959 | Hull | 416/500 X |
| 3,396,905 | 8/1968 | Johnson | 416/190 |
| 3,752,599 | 8/1973 | Pace | 416/190 |
| 4,455,122 | 6/1984 | Schwarzmann | 416/190 |
| 4,505,642 | 3/1985 | Hill | 416/500 |

FOREIGN PATENT DOCUMENTS

| | | | |
|---|---|---|---|
| 1263677 | 5/1961 | France | 416/193 A |

*Primary Examiner*—Everette A. Powell, Jr.

*Attorney, Agent, or Firm*—Cushman, Darby & Cushman

[57] ABSTRACT

An aerofoil balde rotor assembly in which a plurality of aerofoil blades having circumferentially extending platforms are located on the periphery of a rotatable disc. Each of the platforms is provided with tracks on its radially inner surface. The tracks of adjacent platforms define a convergent seating for a ceramic spherical damping member. Each spherical damping member frictionally engages the tracks of adjacent platforms simultaneously upon rotation of the assembly so as to provide aerofoil damping.

9 Claims, 2 Drawing Sheets

AEROFOIL BLADE DAMPING

This invention relates to aerofoil blade damping.

In gas turbine engines and other fluid flow apparatus having annular arrays of rotor aerofoil blades, it is sometimes necessary as a result of vibration problems to provide those blades with some form of damping. Such vibration problems, if allowed to continue unchecked, can in severe cases result in the cracking or even destruction of the blades.

One popular method of providing rotor aerofoil blades with the necessary degree of damping is to provide weights which bridge the gaps between the platforms of circumferentially adjacent blades and are in face-to-face contact with those platform undersides. Upon the rotation of the blade array, each weight is centrifugally urged into frictional engagement with the undersides of adjacent blade platforms, thereby providing the necessary degree dampling. An example of a blade damper of this type is described in UK Patent No. 2043796.

In practice it has been found with dampers of this type that if they are too heavy, there is a tendency for the whole damper/platform assembly to lock-up. This means that frictional damping as a result of relative movement between each damper and the platforms which it engages is not possible. Consequently any relative vibrational movement between the platforms results in the elastic deformation of the damper and platform and this does not provide the desired blade damping.

It is an object of the present invention to provide a rotor aerofoil blade assembly in which there is effective damping of the rotor aerofoil blades.

According to the present invention, an aerofoil blade rotor assembly comprises a rotatable disc member having a plurality of radially extending aerofoil blades located on its periphery, each of said aerofoil blades having circumferentially extending portions which are radially spaced apart from said disc member and circumferentially spaced apart from but aligned with the circumferentially extending portions of adjacent aerofoil blades, and a plurality of spherical damping members, at least one spherical damping member being located in each space defined between said rotatable disc and adjacent circumferentially extending blade portions so that each spherical damping member is centrifugally urged into simultaneous engagement with said adjacent circumferentially extending portions associated therewith upon the rotation of said assembly, each of said circumferentially extending portions being provided with circumferentially extending tracks to receive said spherical damping members in frictional engagement therewith which tracks are so configured that each of said spherical damping members is maintained in simultaneous engagement with said adjacent circumferentially extending portions.

The invention will now be described, by way of example, with reference to the accompanying drawings in which.

Figure 1:
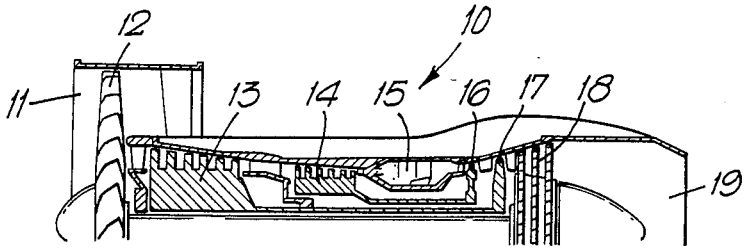
FIG. 1 is a sectioned side view of a ducted fan gas turbine engine which incorporates an aerofoil rotor assembly in accordance with the present invention.

With reference to FIG. 1, a ducted fan gas turbine engine generally indicated at 10 comprises, in axial flow series, an air intake 11, a fan 12, an intermediate pressure compressor 13, a high pressure compressor 14, combustion equipment 15, a high pressure turbine 16, an intermediate pressure turbine 17, a low pressure turbine 18 and an exhaust nozzle 19. The fan 12 is driven by the low pressure compressor 18, the intermediate pressure compressor 13 is driven by the intermediate pressure turbine 17 and the high pressure compressor 14 is driven by the high pressure turbine 16.

The engine 10 operates in the conventional manner whereby the fan 12 provides propulsive thrust and also directs pressurised air to the intermediate pressure compressor 13. There the air is further compressed before passing into the high pressure compressor 14 where it undergoes yet further compression. Finally the compressed air enters the combustion equipment 15 where it is mixed with fuel and the mixture combusted. The resultant combustion products then expand through the high, intermediate and low pressure turbines 16, 17 and 18 before being exhausted through the exhaust nozzle 19 to provide propulsive thrust which supplements that provided by the fan 12.

Figure 2:
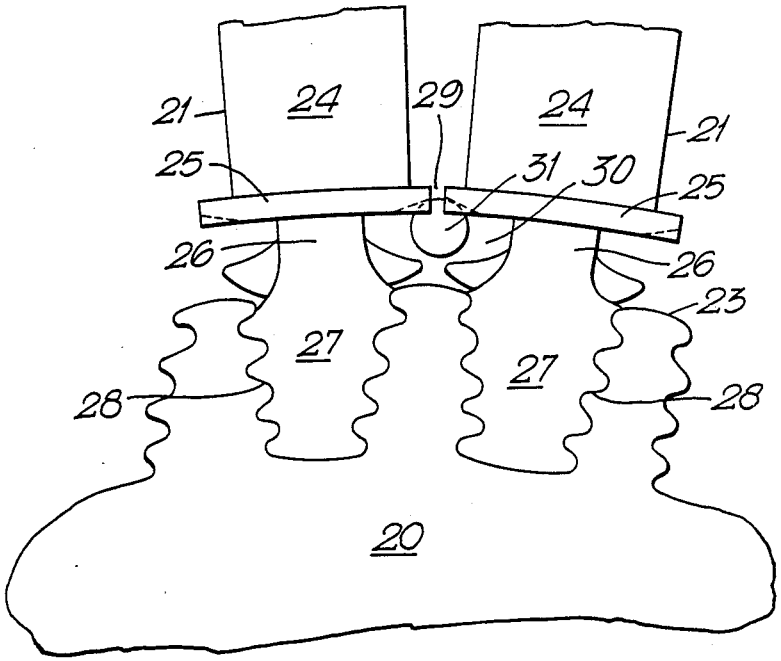
FIG. 2 is an end view of a portion of an aerofoil rotor assembly in accordance with the present invention which is present in the engine shown in FIG. 1.

A portion of the rotor stage of the high pressure turbine 16 can be seen more clearly in FIG. 2. The rotor stage comprises a disc 20 having a plurality of similar radially extending aerofoil blades 21, only two of which can be seen in the drawing, mounted around its periphery 23.

Each of the aerofoil blades 21 comprises an aerofoil portion 24, a platform 25, a shank 26 and a root 27. The root 27 is of the well known fir-tree configuration and locates in an axially extending slot 28 of corresponding configuration which is provided in the disc periphery 23. The blade platforms 25 extend circumferentially but are so dimensioned that the platforms 25 of adjacent blades 21 although aligned with each other do not actually touch so that a small gap 29 is left between them. These gaps 29 ensure that any vibration of the blades 21 occurring during the operation of the engine 10 does not result in platform 25 to platform 25 contact. It will be seen therefore that the platforms 25 define a radially inner boundary to the gas flow which operationally flows over the blade aerofoils 24.

The platforms 25 are radially spaced apart from the disc periphery 23 so that the platforms 25 and shanks 26 of adjacent blades 21 co-operate with the disc periphery 23 to define a series of spaces 30. Each space 30 contains two similar spheres 31 which are formed from a low density, stiff ceramic material such as silicon nitride, alumina or silicon carbide. Each sphere 31 is free to move within its space 30 and end plates (not shown) are provided on the disc 20 to prevent the spheres 31 from falling axially from those spaces 30.

Figure 3:
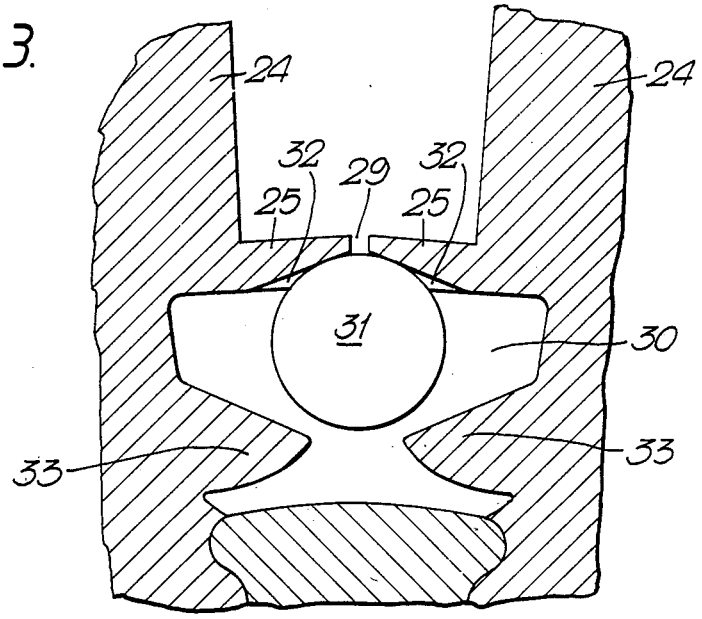
FIG. 3 is an enlarged sectioned end view of a part of the aerofoil rotor assembly portion shown in FIG. 2.
Figure 4:
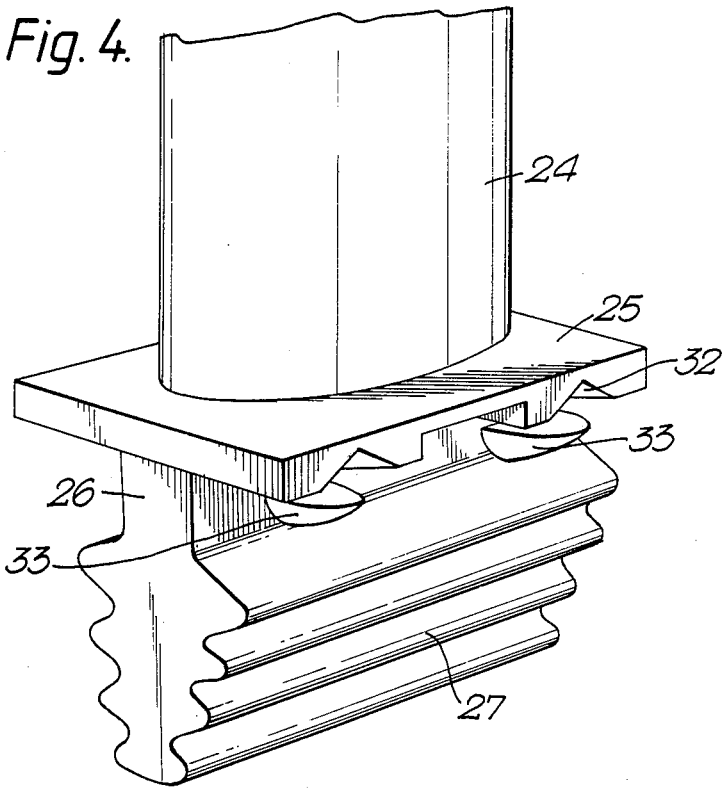
FIG. 4 is a perspective view of the radially inner portion of an aerofoil blade from the aerofoil rotor assembly portion shown in FIG. 2.

When the disc 20 is rotated during normal operation of the engine 10, the spheres 31 are centrifugally urged into engagement with the undersides of the blade platforms 25. Specifically, each sphere 31 is urged into simultaneous engagement with adjacent platforms 25 as can be seen more clearly in FIG. 3. Each sphere 31 locates in tracks 32 provided in the underside surfaces of the platforms 35. Each track 32, as can be seen more clearly in FIG. 4, is of V-shaped cross-sectional shape and is generally circumferentially extending. Moreover, each track 32 is inclined with respect to its associated platform 25 as is readily apparent from FIG. 3. The inclination of the tracks 32 is arranged such that the tracks 32 of adjacent platforms 25 converge in a radially outward direction. Thus the V-shaped cross-sectional shape and convergence of the tracks 32 ensures that they define a seating which fixes each of the spheres 31 in position bridging the gaps 29 between the platforms.

Supports 33 are provided on the shanks 26 to ensure that when the disc 20 is not rotating, the spheres 31 are maintained in such a position that when disc 20 rotation is re-commenced, they return to their original locations simultaneously engaging adjacent platforms 25.

The spheres 31 serve to damp vibration in the blades 21 during engine operation. Thus as each of the blades 21 vibrates and flexes about its shank 26, adjacent platforms 25 move circumferentially towards and away from each other. However the frictional engagement between each sphere 31 and its corresponding adjacent platforms 25 ensures that such relative platform movement, and hence blade 21 vibration, is damped. Thus each platform 25 is in sliding contact with its associated spheres 31 and it is the frictional resistance to that sliding which provides the necessary blade damping. Since the sphere 31 is only in point contact with its associated platform 25, sliding between them is present during all relative circumferential movement between adjacent platforms 25. Consequently there is little likelihood of the platform 25 and sphere 31 assembly locking-up under severe loading and causing inadequate damping.

Although the present invention has been described with reference to a rotor assembly in which two spheres 31 are located in each space 30, it will be appreciated that in certain circumstances, one sphere 31 may be sufficient or alternatively that more than two spheres 31 are necessary. Moreover although the present invention has been described with reference to a turbine rotor assembly 16 with the spheres 31 bearing on the undersides of blade plaforms 25 it will be appreciated that features other than blade platforms could be utilised and that indeed the concept of the present invention could be utilised in a compressor rather than a turbine rotor assembly.

We claim:

1. An aerofoil blade rotor assembly comprising a rotatable disc member having a plurality of radially extending aerofoil blades located on its periphery, each of said aerofoil blades having circumferentially extending portions which are radially spaced apart from said disc member and circumferentially spaced apart from but aligned with the circumferentially extending portions of adjacent aerofoil blades, and a plurality of spherical damping members, at least one spherical damping member being located in each space defined between said rotatable disc and adjacent circumferentially extending blade portions so that each spherical damping member is centrifugally urged into simultaneous engagement with said adjacent circumferentially extending portions associated therewith upon the rotation of said assembly, each of said circumferentially extending portions being provided with circumferentially extending tracks to receive said spherical damping member in frictional engagement therewith, each space having dimensions such that said spherical damping member in each space is free to move from a first position out of contact with said tracks to a second position in which the spherical damping member is in contact with said tracks which tracks are so configured that each of said spherical damping members is maintained in simultaneous engagement with said adjacent circumferentially extending portions upon rotation of the disc.

2. An aerofoil blade rotor assembly as claimed in claim 1 wherein each of said tracks in said circumferentially extending portion cooperates with a track in the circumferentially extending portion adjacent thereto to define a radially outwardly convergent seating for one of said spherical damping members and thereby provide said simultaneous engagement of said spherical damping member with said circumferentially extending portions.

3. An aerofoil blade rotor assembly as claimed in claim 1 wherein said tracks are of substantially V-shaped cross-sectional shape.

4. An aerofoil blade rotor assembly as claimed in claim 1 wherein said circumferentially extending portions on said aerofoil blades are platforms which cooperate to define a portion of the radially inner boundary to a gas passage in which said radially extending aerofoil blades are operationally located.

5. An aerofoil blade rotor assembly as claimed in claim 1 wherein each of said spherical damping members is formed from a ceramic material.

6. An aerofoil blade rotor assembly as claimed in claim 5 wherein each of said spherical damping members is formed from silicon nitride, silicon carbide or alumina.

7. An aerofoil blade rotor assembly as claimed in claim 1 wherein two of said spherical damping members are provided in each of said defined spaces.

8. An aerofoil blade rotor assembly as claimed in claim 1 wherein said assembly is used in a turbine.

9. A gas turbine engine provided with an aerofoil blade rotor assembly as claimed in claim 1.

* * * * *